US005485729A

United States Patent [19]

Higginbotham

[11] Patent Number: 5,485,729

[45] Date of Patent: Jan. 23, 1996

[54] AIR SEPARATION

[75] Inventor: Paul Higginbotham, Guilford, England

[73] Assignee: The BOC Group plc, Windlesham Surrey, United Kingdom

[21] Appl. No.: 354,983

[22] Filed: Dec. 13, 1994

[30] Foreign Application Priority Data

Dec. 15, 1993 [GB] United Kingdom ..... 9325648

[51] Int. Cl.[6] ..... F25J 3/02

[52] U.S. Cl. ..... 62/25; 62/31; 62/38

[58] Field of Search ..... 62/24, 25, 31, 62/38

[56] References Cited

U.S. PATENT DOCUMENTS

| | | | |
|---|---|---|---|
| 4,604,116 | 8/1986 | Erickson | 62/31 X |
| 4,605,427 | 8/1986 | Erickson | 62/31 X |
| 4,936,099 | 6/1990 | Woodward et al. | 62/31 X |
| 5,069,699 | 12/1991 | Agrawal | 62/31 X |
| 5,231,837 | 8/1993 | Ha | 62/24 |
| 5,233,838 | 8/1993 | Howard | 62/25 |
| 5,331,818 | 7/1994 | Rathbone | 62/24 |
| 5,337,570 | 8/1994 | Prosser | 62/25 |
| 5,341,646 | 8/1994 | Agrawal et al. | 62/25 |
| 5,361,590 | 11/1994 | Rathbone | 62/25 |

*Primary Examiner*—Christopher Kilner

*Attorney, Agent, or Firm*—David M. Rosenblum; Larry R. Cassett

[57] ABSTRACT

Nitrogen is separated from a first stream of compressed air in a higher pressure rectification column and from a second stream of compressed air in an intermediate pressure rectification column. Oxygen-enriched liquid is taken from the columns and separated in a lower pressure rectification column. An impure oxygen product is withdrawn in liquid state from the lower pressure column through an outlet. A part of the first air stream is condensed in a first condenser-reboiler, and a part of the second air stream is condensed in a third condenser-reboiler. Nitrogen separated in the higher pressure rectification column is condensed in a second condenser-reboiler, and nitrogen separated in the intermediate pressure rectification column is condensed in a fourth condenser-reboiler. The resulting nitrogen condensate is used as reflux in the columns. The condenser-reboilers provide reboil for the lower pressure rectification column.

21 Claims, 1 Drawing Sheet

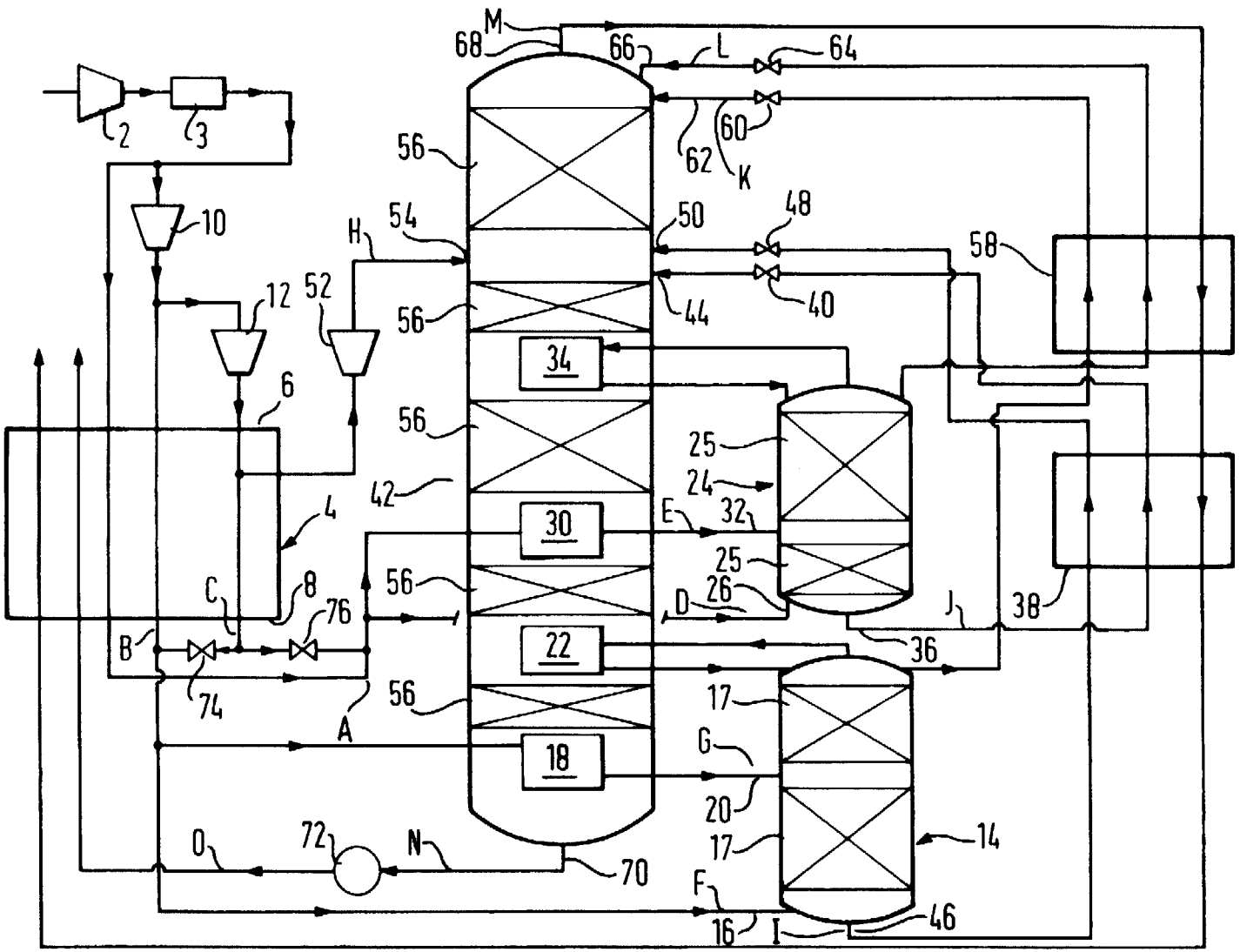
58
38
14
46
64
60
K
48
40
L
62
50
44
36
J
25
24
32
25
26
E
D
17
G
20
17
16
I
F
66
M
68
34
30
22
18
70
56
54
56
56
42
56
56
H
52
12
6
4
8
76
A
N
72
O
3
10
2
C
74
B

AIR SEPARATION

BACKGROUND OF THE INVENTION

This invention relates to a method and apparatus for separating air.

The most important method commercially for separating air is by rectification. A frequently used method of separating air by rectification includes steps of compressing a stream of air, purifying the resulting stream of compressed air by removing from it water vapor and carbon dioxide, and cooling the resulting purified stream of air by heat exchange with returning product streams to a temperature suitable for its rectification. The rectification is performed in a so-called "double rectification column" comprising a higher pressure and a lower pressure rectification column. Most if not all of the air is introduced into the higher pressure rectification column and is separated into oxygen-enriched liquid and nitrogen vapor. The nitrogen vapor is condensed. Part of the condensate is used as liquid reflux in the higher pressure column. Oxygen-enriched liquid is withdrawn from the bottom of the higher pressure column is sub-cooled and is introduced into an intermediate region of the lower pressure column through a throttling or pressure reducing valve. The oxygen-enriched liquid is separated into substantially pure oxygen and nitrogen products in the lower pressure column. These products are withdrawn from the lower pressure column and form the returning streams against which the incoming air is heat exchanged. Liquid reflux for the lower pressure column is provided by taking the remainder of the condensate from the higher pressure column, sub-cooling it, and passing it into the top of the lower pressure column through a throttling or pressure reduction valve.

Conventionally, the lower pressure column is operated with a pressure at its top in the range of 1 to 1.5 bar absolute. Liquid oxygen at the bottom of the lower pressure column is used to meet the condensation duty at the top of the higher pressure column. Accordingly, nitrogen vapor from the top of the higher pressure column is heat exchanged with liquid nitrogen in the bottom of the lower pressure column. Sufficient liquid oxygen is able to be evaporated thereby to meet the requirements of the lower pressure column for reboil and to enable a good yield of gaseous oxygen product to be achieved. The pressure at the top of the higher pressure column and hence the pressure to which the incoming air is compressed are arranged to be such that the temperature of the condensing nitrogen is a degree or two Kelvin higher than that of the boiling oxygen in the lower pressure column. In consequence of these relationships, it is not generally possible to operate the higher pressure column below a pressure of about 5.5 bar.

Improvements to the air separation process enabling the higher pressure column to be operated at a pressure below 5.5 bar have been proposed when the oxygen product is not of high purity. U.S. Pat. No. 4 410 343 discloses that when lower purity oxygen in it is required, rather than having the above-described link between the lower and higher pressure columns, air is employed to boil oxygen in the bottom of the lower pressure column in order both to provide reboil for that column and to evaporate the oxygen product. The resulting condensed air is fed into both the higher pressure and lower pressure columns. A stream of oxygen-enriched liquid is withdrawn from the higher pressure column, is passed through a throttling valve and a part of it is used to perform the nitrogen condensing duty at the top of the higher pressure column.

U.S. Pat. No. 3,210,951 discloses a process for producing impure oxygen in which air is employed to boil oxygen in the bottom of the lower pressure column in order both to provide reboil for that column and to evaporate oxygen product. In this instance, however, oxygen-enriched liquid from an intermediate region of the lower pressure column is used to fulfil the duty of condensing nitrogen vapor produced in the higher pressure column.

Although the process is described in U.S. Pat. Nos. 4,410,343 and 3,210,951 make possible some measure of reduction in the ratio of the operating pressure of the higher pressure column to the operating pressure of the lower pressure column when the oxygen product is not pure, a further improvement would be particularly desirable. The present invention relates to methods and plants for separating impure oxygen from air which are intended to reduce the total power consumption.

According to the present invention there is provided a method of separating air, comprising separating nitrogen from a first stream of compressed air in a higher pressure rectification column, separating nitrogen from a second stream of compressed air in an intermediate pressure rectification column, introducing oxygen-enriched liquid air into a lower pressure rectification column, withdrawing from the lower pressure rectification column an impure oxygen product separated therein from the oxygen-enriched liquid air, and supplying liquid nitrogen reflux to each rectification column, wherein a part of the first air stream is condensed upstream of the higher pressure rectification column by indirect heat exchange with a first liquid stream withdrawn from mass exchange in the lower pressure rectification column, nitrogen taken from mass exchange in the higher pressure rectification column is condensed by indirect heat exchange with a second stream of liquid withdrawn from mass exchange in the lower rectification column, and a part of the second air stream is condensed upstream of the intermediate pressure rectification column by indirect heat exchange with a third stream of liquid withdrawn from mass exchange in the lower pressure rectification column, wherein the first, the second and third streams of liquid are all of a different composition from one another.

The invention also provides apparatus for separating air comprising a higher pressure rectification column for separating nitrogen from a first stream of compressed air, an intermediate pressure rectification column for separating nitrogen from a second stream of compressed air, a lower pressure rectification column for separating an impure oxygen product from oxygen-enriched liquid air, the lower pressure rectification column having an outlet for the impure oxygen product, at least one source of liquid nitrogen reflux for the rectification columns, a first condenser for condensing upstream of the higher pressure rectification column a part of the first stream of compressed air by indirect heat exchange with a first liquid having heat exchange passages communicating with at least one first mass exchange region of the lower pressure rectification column, a second condenser for condensing nitrogen from the higher pressure rectification column by indirect heat exchange with a second liquid having heat exchange passages communicating with at least one second mass exchange region of the lower pressure rectification column, and a third condenser for condensing a part of the second stream of compressed air by indirect heat exchange with a third liquid having heat exchange passages communicating with at least one third mass exchange region of the lower pressure rectification column, wherein the communication between the lower pressure rectification column and each of the condensers is such that in operation the first, second and third liquids are all able to have a different composition from one another.

By employing both the higher pressure rectification column and the intermediate pressure rectification column in the method according to the invention, it is possible to achieve in comparison with conventional processes a reduction in the proportion of the incoming air that has to be compressed to the operating pressure of the higher pressure rectification column or to an even higher pressure. The method according to the invention thus makes possible an overall saving in the power consumed in separating a given volume of air.

Preferably, a fourth stream of liquid is withdrawn from mass exchange in the lower pressure rectification column and is employed to condense nitrogen vapor taken from the intermediate pressure rectification column, the condensation being performed in a fourth condenser. It may alternatively be possible to condense nitrogen taken from the intermediate pressure rectification column by indirect heat exchange with an oxygen-enriched liquid air stream withdrawn from either the higher pressure rectification column or the intermediate pressure rectification column. Condensation of the nitrogen from the higher pressure and intermediate pressure rectification columns typically provides all the liquid nitrogen reflux or the rectification columns employed in the method according to the invention.

The second, third and, if employed, the fourth condensers are preferably each located in the lower pressure rectification column with there being mass exchange between ascending vapor and descending liquid taking place in sections of the column between respective pairs of condensers. The fourth condenser is preferably located above the third condenser with there being mass exchange between rising vapor and descending liquid therebetween. The first condenser is typically located outside the lower pressure rectification column or below the lowest mass exchange region therein. Each of the condensers is able to provide reboil to the lower pressure column. The opportunity thus arises with the method according to the invention to provide reboil at four separate regions of the lower pressure rectification column, thereby facilitating its operation at relatively high thermodynamic efficiency in comparison with the known processes described herein before.

Preferably, the impure oxygen product is withdrawn from the lower pressure column in liquid state. If this oxygen product is required at pressure, it is preferably vaporized by heat exchange with a third air stream at a higher pressure than the first and second air streams. The third air stream is typically at least partially condensed thereby and is preferably introduced into one or more of the rectification columns. For example, a part of the condensed third air stream may be introduced into the higher pressure rectification column and another part into the intermediate pressure rectification column. If desired, such introduction may be effected by premixing the respective part of the condensed third air stream with the first and second air streams, if desired, upstream of the first and third condensers respectively.

If none of the oxygen product is withdrawn from the lower pressure rectification column in liquid state, preferably a portion of that part of the first air stream that is condensed is introduced to the intermediate pressure rectification column.

If the lower pressure rectification column is operated at a pressure at its top of less than 1.5 bar, the oxygen-enriched liquid for separation therein is preferably taken in part from the higher pressure rectification column and in part from the intermediate pressure rectification column.

The respective air streams are preferably taken from one or more sources of compressed air that has been purified by removal of water vapor and carbon dioxide and cooled to a temperature suitable for its separation by rectification. If desired, a fourth stream of air may be formed by taking a part of the air being cooled and expanding it with the performance of external work. The fourth stream of air is preferably introduced into the lower pressure rectification column.

The rectification columns may effect liquid-vapor contact and hence mass exchange between liquid and vapor by using distillation trays or by using packing, for example structured packing. The term "mass exchange region" or "liquid-vapor contact region" as used herein refers in the case of distillation trays to a single distillation tray or in the case of packing to a section of packing.

It is to be understood that the operating pressure at the top of the intermediate pressure column is lower than the operating pressure at the top of the higher pressure rectification column but higher than the pressure at the top of the lower pressure rectification column.

The method and apparatus according to the invention are suitable for use in producing a main oxygen product containing from 80 to 97% by volume of oxygen.

In addition, it is possible to produce at a limited rate a higher purity oxygen product by employing a further liquid-vapor mass exchange region below the level of the lower pressure column from which the main oxygen product is taken, and withdrawing the higher purity product from a lower part of said further mass exchange region. For example, a 99.5% pure oxygen product can be so produced at a rate of up to 15% the rate at which the main oxygen product is taken.

BRIEF DESCRIPTION OF THE DRAWING

The method and apparatus according to the present invention will now be described by way of example with reference to the accompanying drawing which is a schematic flow diagram, not to scale, of an air separation plant.

DETAILED DESCRIPTION

Referring to the drawing, air is compressed in a compressor 2 to a chosen pressure. The resulting flow of compressed air passes through a purification apparatus or unit 3 which removes water vapor and carbon dioxide from the air. The unit 3 employs beds of adsorbent (not shown) to effect this removal of water vapor and carbon dioxide. The beds are operated out of sequence with one another typically such that while one or more beds are being used to purify air, the remainder are being regenerated. Such purification apparatus and its operation are well known in the art and need not be described further. The resulting purified air flow is divided into two streams. One stream passes through a main heat exchanger 4 from its warm end 6 at approximately ambient temperature to its cold end 8. This stream leaves the cold end 8 of the main heat exchanger 4 at a temperature close to its saturation temperature and shall be referred to below as the second air stream. The other part of the purified air stream is further compressed in a second compressor 10. The further compressed air stream is itself divided into two subsidiary streams. One of these subsidiary streams flows through the main heat exchanger 4 from its warm end 6 to its cold end 8. This subsidiary stream of the further compressed air leaves the cold end 8 of the heat exchanger 4 at approximately its saturation temperature and shall be referred to below as the first air stream. The other subsidiary stream of further compressed air flows to a booster-compressor 12 in which its pressure is raised to a higher level yet again. The resulting compressed air leaving the compressor 12 flows through the main heat exchanger 4 from its warm end 6 to its cold end 8, leaving the cold end 8 in liquid state. This liquefied air stream is referred to as the third air stream in the description below. Although not shown in the drawing, it will readily be appreciated that each of the compressors 2, 10 and 12 has an aftercooler associated therewith to remove heat of compression from the compressed air.

One part of the first air stream is introduced into a higher pressure rectification column 14 through an inlet 16. The higher pressure rectification column 14 includes liquid-vapor contact means 17 which may comprise distillation trays or packing in order to effect intimate contact and hence mass exchange between rising vapor and descending liquid. The inlet 16 is located below all the liquid-vapor contact surfaces in the column 14.

The other part of the first air stream flows through a first condenser-reboiler 18 in which it is at least partially condensed by heat exchange with a boiling liquid stream, as will be described below, and is introduced into the higher pressure rectification column 14 through an inlet 20 located in the vicinity of an intermediate mass exchange region within the column 14.

As vapor ascends the higher pressure rectification column 14 so it becomes enriched in nitrogen by virtue of mass exchange with descending liquid. Nitrogen vapor is taken from a top region of the higher pressure rectification column 14 above the liquid-vapor contact means 17 and is condensed in a second condenser-reboiler 22 by heat exchange with a second liquid as shall be described below. A part of the resulting liquid nitrogen condensate is returned to the higher pressure rectification column 14 as reflux, thus providing the necessary downward flow of liquid for the mass exchange to take place. The remainder of the liquid nitrogen condensate is employed in a manner as shall be described below. Liquid passing out of mass exchange relationship with vapor at the bottom of the liquid-vapor contact means 17 is approximately in equilibrium with the incoming air introduced through the inlet 16 and is therefore enriched in oxygen, typically containing from 25 to 40% by volume of oxygen, since oxygen is less volatile than nitrogen.

A part of the second stream of cooled air is introduced into an intermediate pressure rectification column 24 through an inlet 26. The inlet 26 is located at a level below all liquid-vapor contact means 25 in the intermediate pressure rectification column 24. The remainder of the second air stream is condensed by passage through a third condenser-reboiler 30 by indirect heat exchange with a third liquid as shall be described below. The resulting condensed air is introduced into the intermediate pressure rectification column 24 through an inlet 32 located at a level above that of the inlet 26. The vapor introduced into the bottom of the intermediate pressure rectification column 24 through the inlet 26 ascends the column 24 and comes into mass exchange relationship with descending liquid such that the vapor becomes progressively richer in nitrogen and the liquid progressively richer in oxygen. The vapor reaching the top of the intermediate pressure rectification column 24 is essentially pure nitrogen. A stream of the nitrogen is withdrawn from the top of the intermediate pressure rectification column 24 and is condensed in a fourth condenser-reboiler 34 by indirect heat exchange with a fourth stream of liquid as shall be described below. A part of the resulting stream of nitrogen condensate is employed as liquid reflux in the intermediate pressure rectification column 24. Another part of the stream of nitrogen condensate is used as shall be described below.

Liquid passing out of mass exchange relationship with vapor at the bottom of the column is typically approximately in equilibrium with the vaporous air introduced into the bottom of the column 24 through the inlet 26 and is thus enriched in oxygen, typically containing from 25 to 40% by volume of oxygen. A stream of this oxygen-enriched liquid air is withdrawn from the bottom of the intermediate pressure rectification column 24 through an outlet 36, is sub-cooled in a heat exchanger 38, is passed through a throttling valve 40 and is introduced into a lower pressure rectification column 42 through an inlet 44. A stream of oxygen-enriched liquid air is also withdrawn from the bottom of the higher pressure rectification column 14 through an outlet 46, is sub-cooled by passage through the heat exchanger 38, is reduced in pressure by passage through a throttling valve 48 and is introduced into the lower pressure rectification column 42 through an inlet 50. The oxygen-enriched liquid air streams taken from respectively the intermediate pressure and higher pressure rectification columns 24 and 14 thus provide feed streams for separation in the lower pressure rectification column 42. A third feed stream for separation in the lower pressure rectification column 42 is formed by taking a part of the air stream that has been compressed in the booster-compressor 12 at a region intermediate the warm end 6 and the cold end 8 of the main heat exchanger 4 and expanding it with the performance of external work in an expansion turbine 52. The resulting work expanded air leaves the turbine 52 and enters the lower pressure rectification column 42 through an inlet 54. The turbine 52 and the booster-compressor 12 may share a common shaft whereby the turbine 52 is able to provide at least part of the work necessary to drive the booster-compressor 12.

In order to separate the air within the lower pressure rectification column 42, it is provided with liquid-vapor contact means 56 which may take the form of distillation trays or packings. In addition, there is created downward flow of liquid through the column 42 from its top and an upward flow of vapor from its bottom. In order to create the liquid reflux, that part of the liquid nitrogen condensate, formed in the second condenser-reboiler 22, which is not used as reflux in the higher pressure rectification column 14 is sub-cooled by passage through a heat exchanger 58, is reduced in pressure by passage through a throttling valve 60 and is introduced into the top of the lower pressure rectification column 42 through an inlet 62. This flow of liquid nitrogen is augmented by taking that part of the condensate formed in the fourth condenser-reboiler 34 which is not used as reflux in the intermediate pressure rectification column 24, sub-cooling it by passage through the heat exchanger 58, reducing its pressure by passage through a throttling valve 64 and introducing it into the top of the rectification column 42 through an inlet 66.

A flow of vapor upwardly through the lower pressure rectification column 42 is created by taking a first stream of liquid from a first mass exchange region (the bottom most region) of the liquid-vapor contact means 56 in the column 42 and employing it as first liquid in the condenser-reboiler 18. Typically, the first condenser-reboiler 18 is of the thermosiphon kind with its condensing passages formed in a heat exchange block (not shown) which is at least partially immersed in a volume of the first liquid. A part of the first liquid is reboiled by heat exchange with the condensing first stream of air and the resulting vapor passes upwardly through the lower pressure rectification column 42. This upward flow of vapor through the lower pressure rectification column 42 is augmented by operation of the second, third and fourth condenser-reboilers 22, 30 and 34. The second condenser-reboiler 22 is located in the lower pressure rectification column 42 at a level above that of the first condenser-reboiler 18, with there being liquid-vapor contact means 56 therebetween. A second liquid is taken out of mass exchange relationship with ascending vapor from the next liquid-vapor contact region above the second condenser-reboiler 22 in the column 42 and is employed to condense nitrogen therein, the second liquid being itself at least partially reboiled. Since there are vapor-liquid contact means 56 between the first reboiler 18 and the second reboiler 22, the second liquid is less rich in oxygen than the first liquid. The third condenser-reboiler 30 is also located within the lower pressure rectification column 42 above the second condenser-reboiler 22 with there being liquid-vapor contact means 56 therebetween. A third liquid, less rich in oxygen than the second liquid, flows out of mass exchange relationship with ascending vapor from the next mass exchange region above the third condenser-reboiler 30. The third liquid in the lower pressure rectification column 42 and is employed therein to condense air, the third liquid being itself at least partially reboiled. Resulting vapor passes out of the third condenser-reboiler 30 and augments the flow of vapor upwardly through the lower pressure rectification column 42. The fourth condenser-reboiler 34 is located within the lower pressure rectification column 42 above the third condenser-reboiler 30 with there being liquid-vapor mass exchange means 56 therebetween. A fourth liquid, less rich in oxygen than the third liquid, flows out of mass exchange relationship with vapor at the next mass exchange region above the fourth condenser-reboiler 34 in the lower pressure rectification column 42. The fourth liquid is employed therein to condense nitrogen. The fourth liquid is itself at least partially reboiled by heat exchange with the condensing nitrogen. The resulting vapor passes out of the fourth condenser-reboiler 34 and is used to augment the upward flow of vapor through the lower pressure rectification column 42. By meeting the reboil duty on the lower pressure rectification column 42 at four spaced locations, relatively thermodynamically efficient operation of the lower pressure rectification column 42 is facilitated.

A nitrogen stream is withdrawn from the top of the lower pressure rectification column 42 through an outlet 68 and flows through the heat exchanger 58 countercurrently to the liquid nitrogen streams being sub-cooled. The nitrogen stream taken from the outlet 68 of the lower pressure rectification column 42 leaves the heat exchanger 58 and passes through a heat exchanger 38 countercurrently to the oxygen-enriched liquid air streams being sub-cooled. The nitrogen stream thus provides cooling for the heat exchangers 38 and 58. From the heat exchanger 38 the nitrogen stream passes through the main heat exchanger 4 from its cold end 8 to its warm end 6 and is thereby warmed to approximately ambient temperature and may be taken as nitrogen product.

That part of the first liquid which is not reboiled in the first condenser-reboiler 18 is taken as an impure liquid oxygen product from the bottom of the lower pressure rectification column 42 through an outlet 70 by means of a liquid oxygen pump 72 which raises its pressure typically to above that of the first and second air streams. The resulting pressurized liquid oxygen stream, typically containing 95% by volume of oxygen, is vaporized by passage through the main heat exchanger 4 from its cold end 8 to its warm end 6. Relatively efficient operation of the main heat exchanger 4 is facilitated by appropriate selection of the outlet pressure of the booster-compressor 12 so as to maintain a close match between the enthalpy-temperature profile of the pressurized oxygen stream and that of the air stream from the booster compressor 12 as they pass through the main heat exchanger 4. Moreover, by being able to take a condensed air stream as the third air stream from the main heat exchanger 4, an enhancement in the efficiency with which the higher pressure rectification column 14 and the intermediate pressure rectification column 24 operate is made possible. To this end, one part of the third air stream is passed through a throttling valve 74 and is introduced into the first air stream at a region of the latter upstream of its division into two parts. The remainder of the third air stream is passed through a throttling valve 76 and is introduced into the second air stream at a region upstream of the division of the latter into two parts.

Although not shown in the drawing, if desired, a waste nitrogen stream may be withdrawn from a mass exchange region of the lower pressure rectification column 42 a few trays below the top tray in the column 42 (if it is trayed, or at a corresponding level, if it is packed) and passed through the heat exchangers 58, 38 and 4, in sequence, cocurrently with the product nitrogen stream withdrawn from the top of the column 42 through the outlet 68. Such a practice facilitates the production of an improved purity nitrogen product.

In a typical example of the operation of the plant shown in the accompanying drawing, the pressure at the bottom of the higher pressure rectification column 14 is 4.5 bar, the pressure at the bottom of the intermediate pressure rectification column 24 is 2.8 bar, and the pressure at the bottom of the lower pressure rectification column 42 is 1.5 bar. In this example, the booster compressor 12 has an outlet pressure of approximately 15 bar and the turbine 52 an outlet pressure of approximately 1.3 bar. In addition, in this example the pump 72 raises the pressure of the impure liquid oxygen product to 6 bar.

The operation of the plant shown in the accompanying drawing in accordance with the invention is further illustrated in Table 1 in which we set out the flow rate, temperature, pressure composition and state of the process streams identified in FIG. 1 by the letters A to O.

TABLE 1

| stream | flow rate/ $sm^3\ hr^{-1}$ | pressure/ bar | temperature/ K | composition mole fraction $O_2$ | Ar | $N_2$ | state* |
|---|---|---|---|---|---|---|---|
| A | 370.0 | 2.8 | 97.8 | 0.21 | 0.01 | 0.78 | 100% V |
| B | 280.0 | 4.8 | 97.8 | 0.21 | 0.01 | 0.78 | 99% V |

TABLE 1-continued

| stream | flow rate/ $sm^3 hr^{-1}$ | pressure/ bar | temperature/ K | composition mole fraction $O_2$ | Ar | $N_2$ | state* |
|---|---|---|---|---|---|---|---|
| C | 290.0 | 15.0 | 97.8 | 0.21 | 0.01 | 0.78 | 100% L |
| D | 395.0 | 2.8 | 90.6 | 0.21 | 0.01 | 0.78 | 78% V |
| E | 135.0 | 2.8 | 89.0 | 0.21 | 0.01 | 0.78 | 100% L |
| F | 230.0 | 4.8 | 96.9 | 0.21 | 0.01 | 0.78 | 70% V |
| G | 180.0 | 4.8 | 95.5 | 0.21 | 0.01 | 0.78 | 100% L |
| H | 60.0 | 1.3 | 87.9 | 0.21 | 0.01 | 0.78 | 100% V |
| I | 319.0 | 4.8 | 96.2 | 0.27 | 0.01 | 0.72 | 100% L |
| J | 337.0 | 2.8 | 90.2 | 0.33 | 0.01 | 0.67 | 100% L |
| K | 91.0 | 1.2 | 78.8 | 0.00 | 0.00 | 1.00 | 98% L |
| L | 193.0 | 1.2 | 78.8 | 0.00 | 0.00 | 1.00 | 98% L |
| M | 780.2 | 1.2 | 78.8 | 0.00 | 0.00 | 1.00 | 100% V |
| N | 219.8 | 1.5 | 93.5 | 0.95 | 0.03 | 0.02 | 100% L |
| O | 219.8 | 6.0 | 93.8 | 0.95 | 0.03 | 0.02 | 100% L |

*Percentages are by volume

I claim:

1. A method of separating air, comprising:

separating nitrogen from a first stream of compressed air in a higher pressure rectification column;

separating nitrogen from a second stream of compressed air in an intermediate pressure rectification column;

introducing oxygen-enriched liquid air into a lower pressure rectification column;

withdrawing from the lower pressure rectification column an impure oxygen product separated therein from the oxygen-enriched liquid air;

supplying liquid nitrogen reflux to each rectification column;

condensing a part of the first air stream upstream of the higher pressure rectification column by indirect heat exchange with a first liquid stream withdrawn from mass exchange in the lower pressure rectification column;

condensing nitrogen taken from mass exchange in the higher pressure rectification column by indirect heat exchange with a second stream of liquid withdrawn from mass exchange in the lower rectification column and condensing a part of the second air stream upstream of the intermediate pressure rectification column by indirect heat exchange with a third stream of liquid withdrawn from mass exchange in the lower pressure rectification column;

the first, second and third streams of liquid being all of a different composition from one another.

2. The method as claimed in claim 1, in which the first liquid is taken from the lowest mass exchange region in the lower pressure rectification column.

3. The method as claimed in claim 1, in which the concentration of oxygen in the second liquid is lower in the second liquid than in the first liquid.

4. The method as claimed in claim 1, in which the impure oxygen product is withdrawn from the lower pressure rectification column in liquid state.

5. The method as claimed in claim 4, in which the impure liquid oxygen product is vaporized by heat exchange with a third air stream at a higher pressure than the first and second air streams.

6. The method as claimed in claim 5, in which the third air stream is at least partially condensed and is introduced into one or more of the rectification columns.

7. The method as claimed in claim 6, in which a part of the condensed third air stream is introduced into the higher pressure rectification column and another part is introduced into the intermediate pressure rectification column.

8. The method as claimed in claim 1, wherein a fourth air stream is expanded with the performance of external work and is introduced into at least one of the rectification columns.

9. The method as claimed in claim 1, wherein a fourth stream of liquid is withdrawn from mass exchange in the lower pressure rectification column and is employed to condense nitrogen from the intermediate pressure column.

10. The method as claimed in claim 1, in which the fourth liquid is less rich in oxygen than the third liquid.

11. The method as claimed in claim 1, wherein the impure oxygen product contains from 80 to 97% by volume of oxygen.

12. The method as claimed in claim 1, in which in addition to the impure oxygen, a relatively pure oxygen is produced.

13. An apparatus for separating air comprising:

a higher pressure rectification column for separating nitrogen from a first stream of compressed air;

an intermediate pressure rectification column for separating nitrogen from a second stream of compressed air;

a lower pressure rectification column for separating an impure oxygen product from oxygen-enriched liquid air;

the lower pressure rectification column having an outlet for the impure oxygen product;

at least one source of liquid nitrogen reflux for the rectification columns;

a first condenser for condensing upstream of the higher pressure rectification column a part of the first stream of compressed air by indirect heat exchange with a first liquid, said first condenser having heat exchange passages communicating with at least one first mass exchange region of the lower pressure rectification column;

a second condenser for condensing nitrogen from the higher pressure rectification column by indirect heat exchange with a second liquid, said second condenser having heat exchange passages communicating with at least one second mass exchange region of the lower pressure rectification column and a third condenser for condensing a part of the second stream of compressed air by indirect heat exchange with a third liquid, said third condenser having heat exchange passages communicating with at least one third mass exchange region of the lower pressure rectification column;

the communication between the lower pressure rectification column and each of the first, second and third condensers is such that in operation the first, second and third liquids are all able to have a different composition from one another.

14. The apparatus as claimed in claim 13, in which the first condenser has boiling passages communicating with the lowest mass exchange region in the lower pressure rectification column.

15. The apparatus as claimed in claim 13, in which the second and third condensers are located within the lower pressure rectification column with the third condenser above the second condenser, whereby the third liquid is able to be taken having a composition whose oxygen content is less than that of the second liquid.

16. The apparatus as claimed in claim 13, in which there is a fourth condenser for condensing nitrogen from the intermediate pressure column by indirect heat exchange with a fourth liquid taken out of mass exchange with ascending vapor in the lower pressure rectification column.

17. The apparatus as claimed in claim 16, in which the fourth condenser is located within the lower pressure rectification column above the third condenser, whereby the fourth liquid is able to be taken having a composition less rich in oxygen than the third liquid.

18. The apparatus as claimed in claim 13, wherein the outlet for impure liquid oxygen product communicates with a bottom mass exchange region of the lower pressure rectification column.

19. The apparatus as claimed in claim 18, additionally including a heat exchanger for boiling the impure liquid oxygen product by heat exchange with a third stream of air.

20. The apparatus as claimed in claim 19, including means for introducing the third air stream, in at least partially condensed state, into at least one of the rectification columns.

21. The apparatus as claimed in 13, additionally including an expansion turbine for expanding with the performance of e external work a fourth air stream, the expansion turbine having an outlet communicating with the lower pressure rectification column.

* * * * *